United States Patent [19]

Hamsher, Jr. et al.

[11] Patent Number: 4,491,381

[45] Date of Patent: Jan. 1, 1985

[54] ELECTRICAL PANELBOARD CONNECTOR

[75] Inventors: Wilbur A. Hamsher, Jr., New Cumberland; Daniel E. Stahl, Harrisburg, both of Pa.

[73] Assignee: AMP Incorporated, Harrisburg, Pa.

[21] Appl. No.: 506,964

[22] Filed: Jun. 23, 1983

[51] Int. Cl.[3] ..... H01R 13/58

[52] U.S. Cl. ..... 339/107; 339/14 R; 339/74 R

[58] Field of Search ..... 339/14 R, 74 R, 75 R, 339/99 R, 103 M, 107, 276 R

[56] References Cited

U.S. PATENT DOCUMENTS

| | | | |
|---|---|---|---|
| 3,533,044 | 10/1970 | Bauman et al. | 339/14 |
| 3,705,376 | 12/1972 | Kinkaid et al. | 339/75 R X |
| 3,796,987 | 3/1974 | Kinkaid et al. | 339/74 R X |
| 3,864,010 | 2/1975 | Wasserlein, Jr. | 339/97 R |
| 3,874,764 | 4/1975 | Volinskie | 339/97 R |
| 4,040,703 | 8/1977 | Shaffer et al. | 339/99 R |
| 4,277,124 | 7/1981 | Loose et al. | 339/99 R |

OTHER PUBLICATIONS

"A Mass-Termination, Filtered Connector for RS--23-2-C Circuits" B. F. Whittaker, Amphenol, 10-1980, FIG. 4.

*Primary Examiner*—Eugene F. Desmond

*Attorney, Agent, or Firm*—Adrian J. LaRue; Anton P. Ness

[57] ABSTRACT

An electrical connector comprises a dielectric housing member in which signal and ground terminal members are secured with contact sections of the terminal members in alignment with respective openings at a front end of the housing member into which a pin terminal and a ground rail of a panelboard extend for electrical connection with the contact sections of the signal and ground terminal members. Termination sections of the signal and ground terminal members extend outwardly from a rear end of the housing member for terminating the signal and ground conductors of a cable thereto. A securing section is part of the signal terminal member or ground terminal member for securing a section of the cable therein as a cable strain relief. Dielectric cover members are latchably secured together onto the housing member and covering the termination sections terminated to the signal and ground conductors and the securing section secured to the cable section and engaging the cable as an added cable strain relief.

9 Claims, 9 Drawing Figures

148
26
12
40
36
30
140
32
38
42
38
35
34
32
114
116
106
112
104
154
10
116
156
96
112
108
98
110
24
100
94
76
74
90
154
64
78
88
80
102
122
156
82
58
20
62
54
22
70
52
72
56
66
68
86
60
48
130
134
126
28
136
134
132
124
120

ELECTRICAL PANELBOARD CONNECTOR

FIELD OF THE INVENTION

The present invention relates to electrical connectors and more particularly to electrical connectors for connecting electrical cables to electrical terminals of a panelboard, circuit board or the like.

BACKGROUND OF THE INVENTION

Several types of electrical cables are used in electrical connectors for connecting the cables to electrical terminals of a panelboard, circuit board or the like. One type is a trilead cable of generally rectangular configuration in cross-section and having a signal conductor with ground conductors along opposite sides encased in an insulating jacket. Another type is a circular shielded trilead cable with includes an outer conductor electrically encircling the ground conductors between the insulated signal conductor and the insulating jacket. A further type is a shielded trilead triaxial cable which has a ground wire and braided conductor extending along the insulating jacket and surrounded by an outer insulating jacket.

Electrical connectors are known to terminate each of these various types of cables, but none is known to terminate all of these cables, to enable contacts of a test probe to be electrically connected to the signal and ground terminals of tightly-packed connectors on a panelboard or circuit board or to test the connections and terminations, which positively retains the connectors on the panelboard, and has an integral cable strain relief.

SUMMARY OF THE INVENTION

According to the present invention, an electrical connector comprises a dielectric housing member in which signal and ground terminal members are secured with contact sections of the terminal members in alignment with respective openings at a front end of the housing member into which a pin terminal and a ground rail of a panelboard extend for electrical connection with the contact sections of the signal and ground terminal members. Termination sections of the signal and ground terminal members extend outwardly from a rear end of the housing member for terminating the signal and ground conductors of a cable thereto. A securing section is part of the signal terminal member or ground terminal member for securing a section of the cable therein as a cable strain relief. Dielectric cover members are latchably secured together onto the housing member and cover the termination sections terminated to the signal and ground conductors and the securing section secured to the cable section thereby engaging the cable as an added cable strain relief.

According to another feature of the present invention, apertures are located in one of the cover members enabling electrical contacts of a probe to extend through the openings and electrically engage the signal and ground terminal members to determine the integrity of the electrical terminations and the electrical connections.

According to a further feature of the present invention, the contact section of the signal terminal member is latchably connected onto the pin terminal and can be disconnected therefrom by movement of the housing member away from the pin terminal which detaches the signal terminal member therefrom.

DETAILED DESCRIPTION OF THE INVENTION

Figure 1:
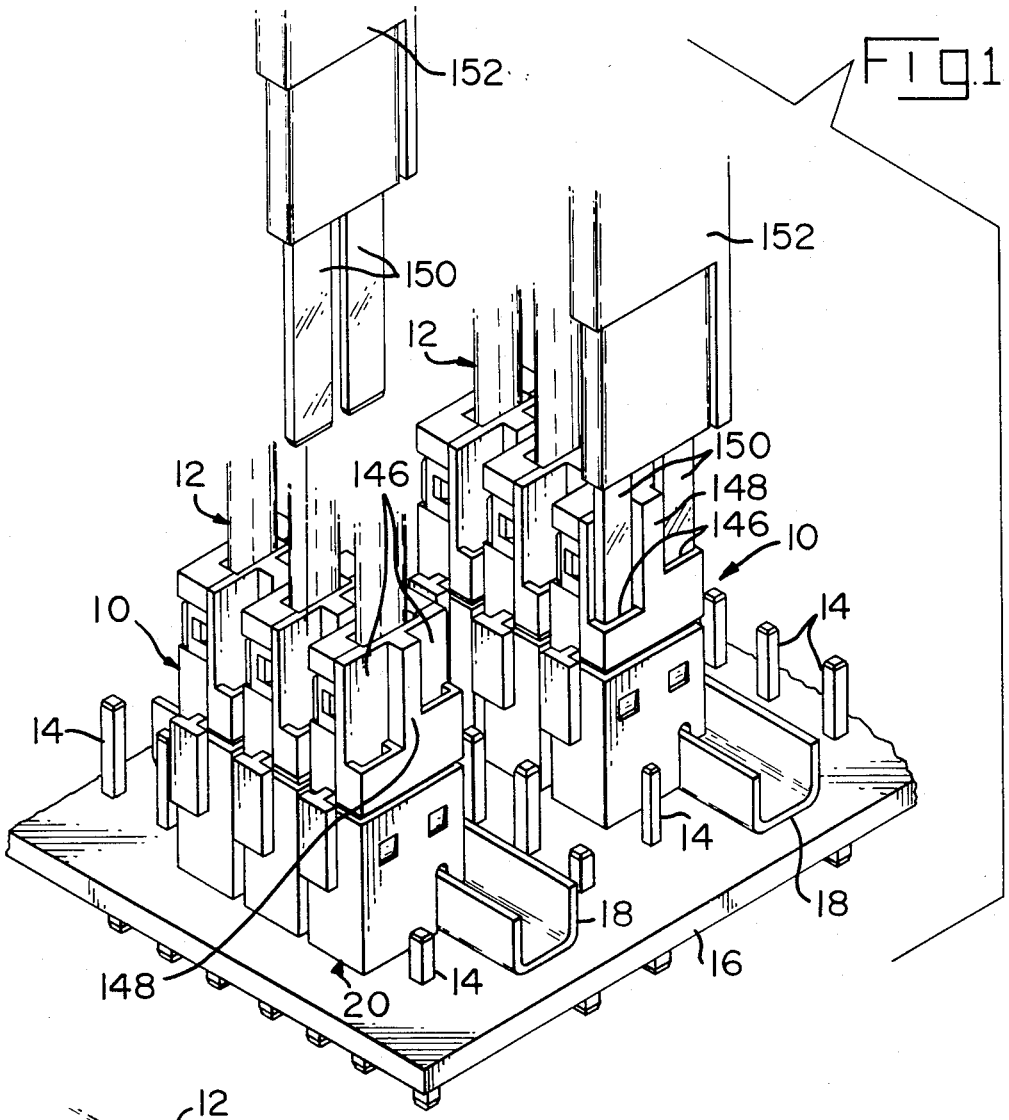
FIG. 1 is a fragmentary perspective view showing a portion of a panelboard having terminal pins and ground rails mounted thereon and with electrical connectors making electrical interconnection therewith, and an electrical probe exploded therefrom.
Figure 3:
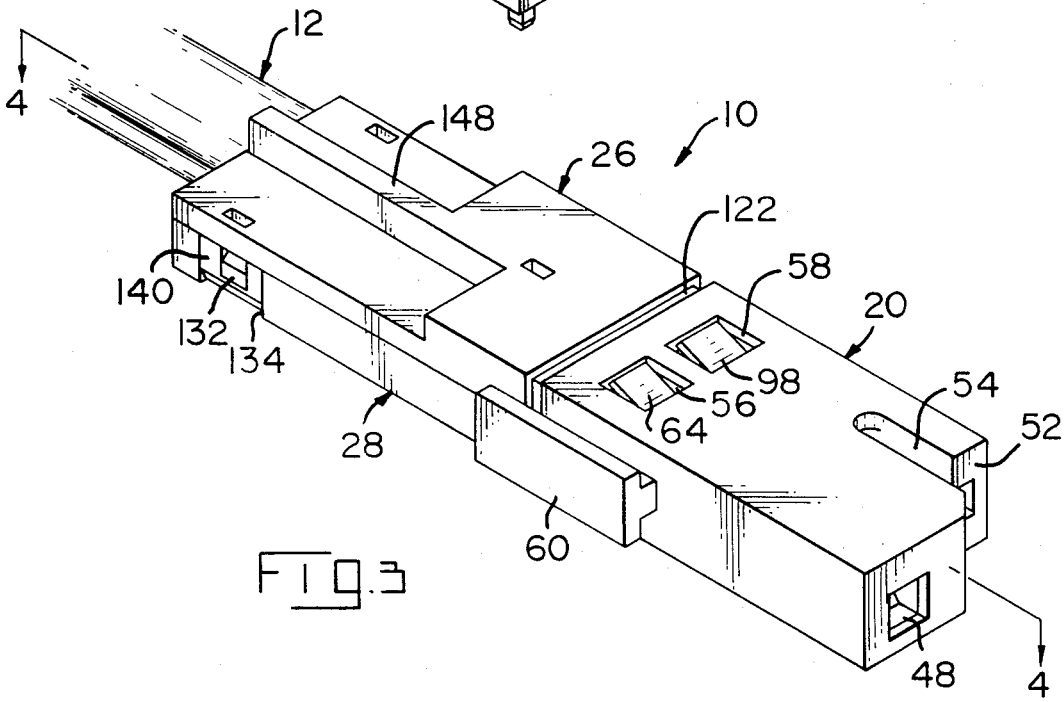
FIG. 3 is a perspective view showing the connector in an assembled condition.

Electrical panelboard connectors 10 are shown in use in FIG. 1 whereby they terminate the signal and ground conductors of electrical cables 12 and connect them to respective pin terminals 14 arranged in rows in panelboard 16 on opposite sides of elongated channel-shaped ground rails 18.

Each of electrical panelboard connectors 10 includes a dielectric housing member 20, a signal terminal member 22, a ground terminal member 24, and dielectric cover members 26 and 28. Dielectric housing member 20 and cover members 26 and 28 are molded from a suitable plastic material and signal terminal and ground terminal members 22 and 24 are stamped and formed from a suitable metal.

Figure 2:
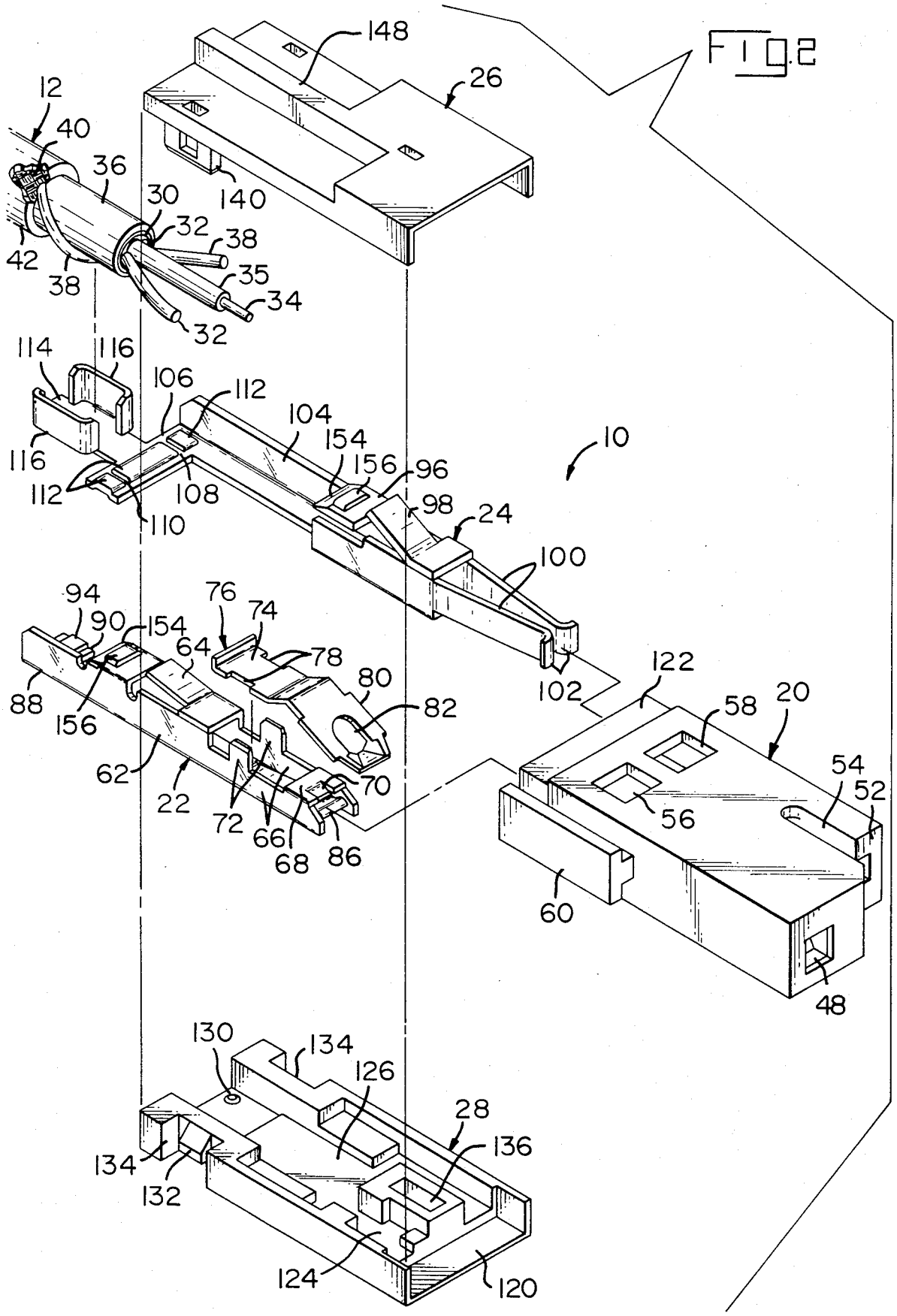
FIG. 2 is a perspective exploded view of the parts of the electrical connector.

Cable 12 is a circular shielded trilead triaxial cable which includes an outer conductor 30 electrically encircling the ground conductors 32 between signal conductor 34 and insulating jacket 36; an insulation sheath 35 covers signal conductor 34. A ground conductor 38 and braid 40 extend along insulating jacket 36 and are covered by outer insulating jacket 42. Cable 12 is stripped as shown in FIG. 2 with one of ground conductors 32 being cut off at the end of outer conductor 30 and insulating jacket 36 prior to the stripped end of cable 12 being terminated in signal and ground terminal members 22 and 24.

Housing member 20 includes parallel passageways 44 and 46 in which signal terminal member 22 and ground terminal member 24 are respectively disposed. Passageway 44 is in communication with an opening 48 at the front end of housing member 20. A camming surface 50 is located at the front end of passageway 44. Housing member 20 includes a stepped section 52 spaced from the front surface which has a slot 54 therein that is in communication with passageway 46. Latching apertures 56 and 58 are located in housing member 20 in communication with passageways 44 and 46. A T-shaped member 60 is located on housing member 20 which is to be engaged by a tool (not shown) to facilitate the mounting on and removal from the pin terminals and ground rails of panelboard 16.

Figure 7:
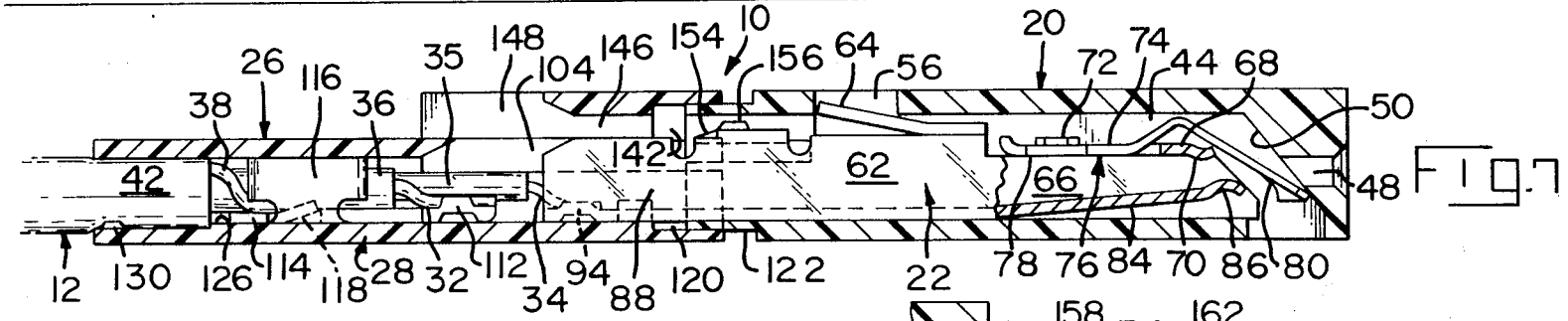
FIG. 7 is a view similar to FIG. 6 showing the connector in an assembled condition.
Figure 8:
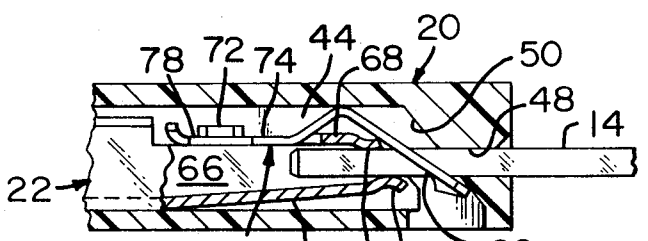
FIG. 8 is a part longitudinal section view similar to FIG. 7 showing the pin terminal in electrical engagement in the receptacle section of the signal terminal member.

Signal terminal member 22 is of the type disclosed in U.S. Pat. Nos. 3,705,376 and 3,796,987 and has a box-shaped section 62 from which extends a lance 64 that is disposed within latching aperture 56 when terminal member 22 is disposed is passageway 44 of housing member 20 latching terminal member 22 in position therein as shown in FIG. 7. Side members 66 extend outwardly from the sides of section 62 in a forward direction therefrom in parallel relationship to one another and they are connected at their front ends by a bridging member 68 which has a radiused section 70 struck inwardly therefrom. Lugs 72 extend outwardly from the top surfaces of side members 66 opposite one another and they are bent into engagement with a flat section 74 of spring member 76 which engages the top surfaces of side members 66 and is maintained in engagement therewith. Recesses 78 are located in flat section 74 in which lugs 72 are disposed to prevent spring member 76 from moving back and forth along side members 66. A profiled spring section 80 is located at the front end of spring member 76 and extends across the front end of terminal member 22. An elongated aperture 82 is located in spring section 80 in alignment with opening 48 to permit pin terminal 14 to have access to the receptacle section of terminal member 22 through aperture 82 as shown in FIG. 8. Leaf spring contact member 84 is cantilevered outwardly from the bottom of box-shaped section 62 in a direction toward bridging member 68 and terminates with a radiused front end 86 spaced forwardly from radiused section 70. Thus, when pin terminal 14 is inserted into the receptacle section of terminal member 22 through elongated aperture 82 of spring section 80, radiused section 70 and radiused front end 86 electrically engage pin terminal 14 at axially-spaced locations and spring section 80 engages pin terminal 14 thereby locking it in position therein. Movement of housing member 20 away from panelboard 16 causes spring section 80 to engage camming surface 50 which moves spring section 80 free of pin terminal 14 enabling connector 10 to be removed from panelboard 16.

An L-shaped terminating section 88 extends rearwardly from box-shaped section 62 and outwardly from the rear end of housing member 20 and it has a projection 90 in which a channel 92 is formed by spaced protrusions 94.

Figure 4:
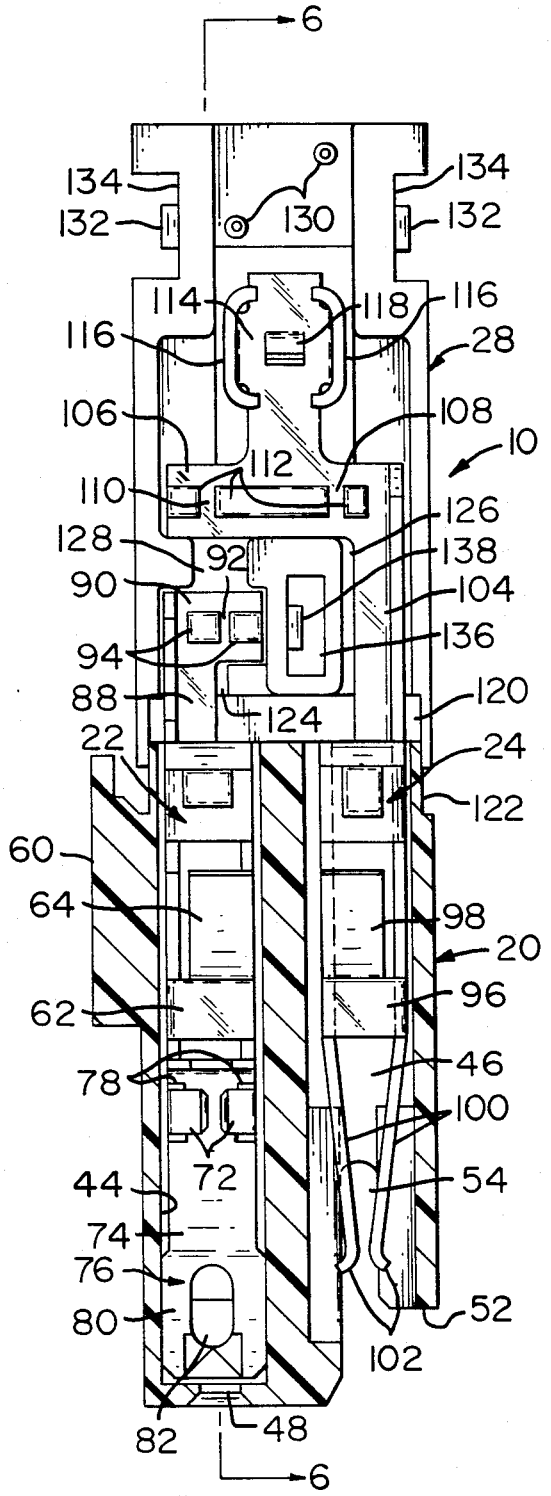
FIG. 4 is a longitudinal section view taken along lines 4—4 of FIG. 3 without the cable terminated to the terminal members therein.
Figure 5:
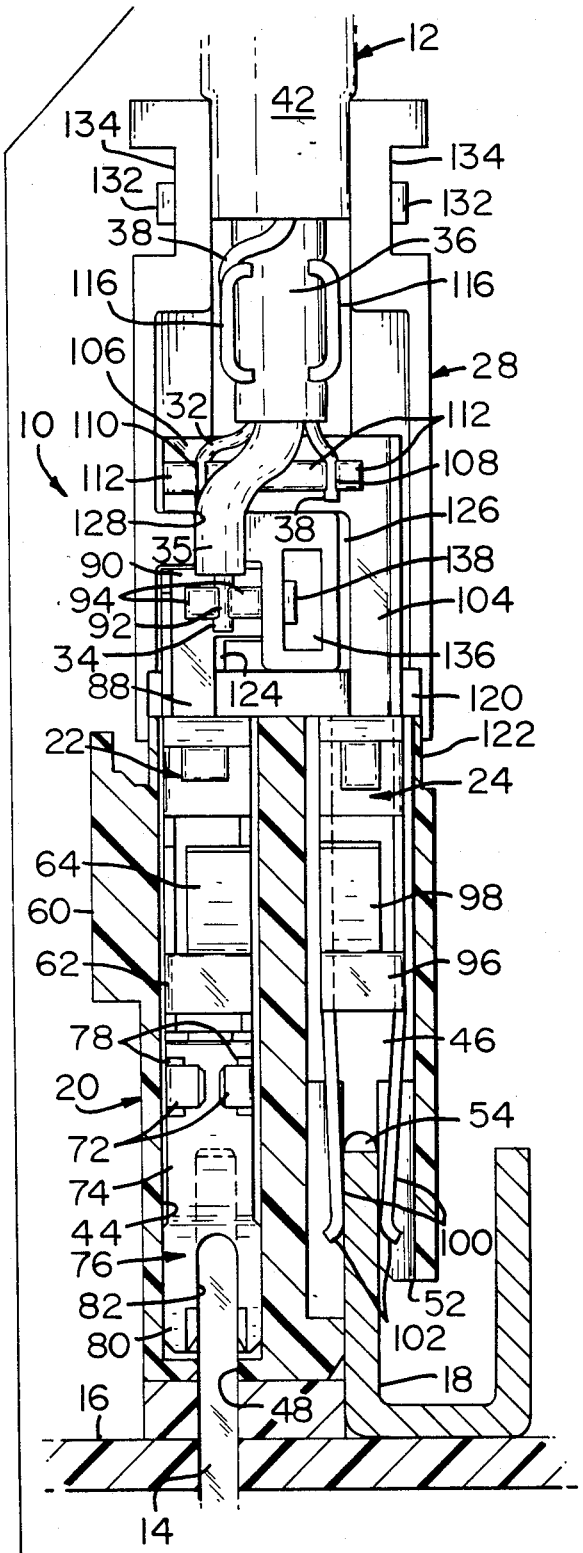
FIG. 5 is a view similar to FIG. 4 with the signal and ground conductors of the cable terminated to the terminal members therein.
Figure 6:
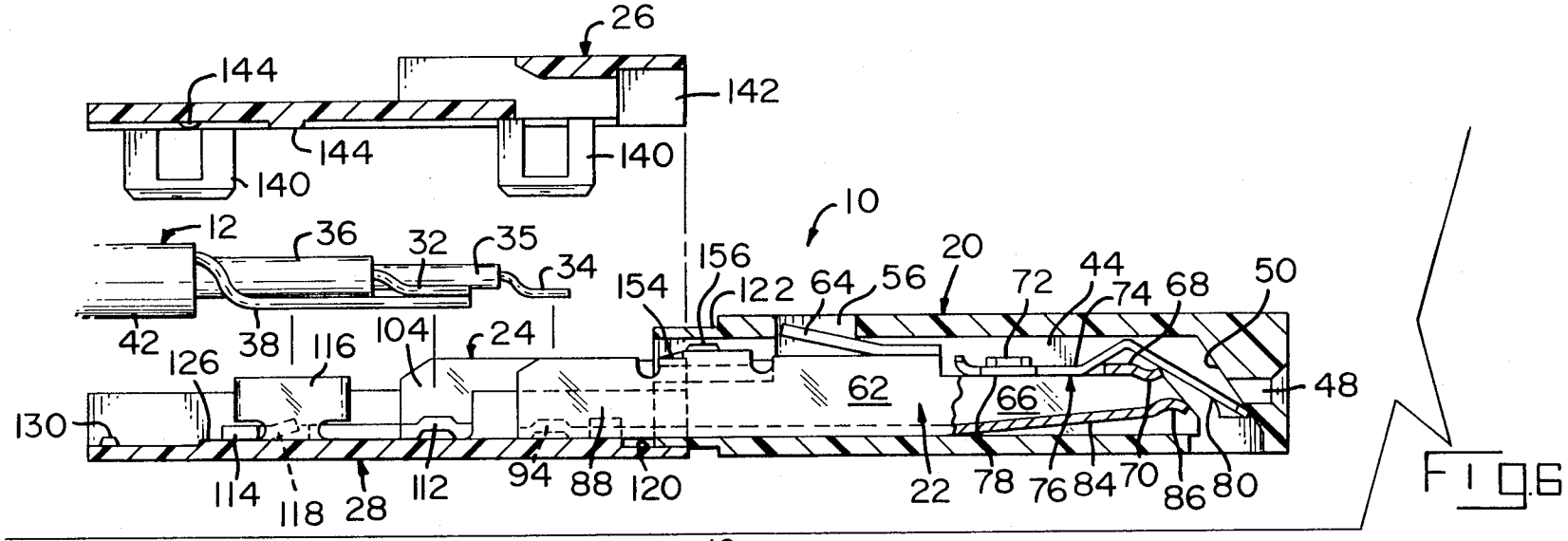
FIG. 6 is a longitudinal section view taken along line 6—6 of FIG. 4 with the cable and top cover member in exploded positions.

Ground terminal member 24 has a box-shaped section 96 from which is struck a lance 98 for disposition in latching aperture 58 to latchably secure terminal member 24 in passageway 46 of housing member 20 as shown in FIGS. 4 and 5. Leaf spring contact members 100 are cantilevered respectively from the sides of section 96 in a direction toward each other and they have radiused front ends 102 disposed within slot 54 as shown in FIG. 4, radiused front ends 102 electrically engaging a leg of ground rail 18 through slot 54 as shown in FIG. 5. L-shaped terminating section 104 extends rearwardly from box-shaped section 96 and outwardly from housing member 20 and has a projection 106 in which channels 108 and 110 are formed by protrusions 112.

A strain relief section 114 extends outwardly from projection 106 and it includes C-shaped sidewalls 116 and a forwardly directed projection 118 struck from the bottom wall of strain relief section 114.

With terminals 22 and 24 latchably secured in passageways 44 and 46 of housing member 20, a stripped end of cable 12 is terminated to terminal members 22 and 24. One of ground conductors 32 is cut off at the front end of outer conductor 30 and insulting jactet 36. With ground conductor 38 disposed under insulating jacket 36, insulating jacket 36 is forced between C-shaped sidewalls 116 and into engagement with forwardly directed projections 118 thereby providing a strain relief for cable 12 in strain relief section 114. Ground conductors 32 and 38 are positioned in channels 110 and 108 while signal conductor 34 is positioned in channel 92 and these conductors are welded or soldered in position therein. As can be discerned from FIG. 7, C-shaped sidewalls 116 and forwardly-directed projection 118 bite into insulating jacket 36 thereby forming a strain relief for cable 12.

Cover member 28 has a relief area 120 along the inside surface at the front end thereof which extends along an undercut section 122 along the outside surface of housing member 20 at the rear end thereof. Profiled recess 124 receives therein terminating section 88 of signal terminal member 22 while profiled recess 126 receives terminating section 104 and strain relief section 114 of ground terminal member 24 therein. A channel 128 extends between recesses 124 and 126 and receives therein insulation sheath 35 surrounding signal conductor 34. Projections 130 extend outwardly from an outer end of recess 126 for engagement with outer insulating jacket 42 of cable 12 when disposed therein to provide additional strain relief. Latching projections 132 are located in recesses 134 in the sides of cover member 28. An opening 136 has a latching projection 138 therein as shown in FIGS. 4 and 5.

Cover member 26 includes flexible latching members 140 which latchably engage onto latching projections 132 and 138 thereby latchably securing cover member 26 to cover member 28. Cover member 26 also includes a relief area 142 that extends along undercut section 122 of housing member 20. Projections 144 are located on the inside surface of cover member 26 to engage respectively insulating jacket 36 to maintain it in position in C-shaped sidewalls 116 and to engage outer insulating jacket 42 in conjunction with projections 130 to form a strain relief thereon.

Openings 146 are located on each side of a rib 148 of cover member 26, openings 146 being in alignment with respective terminal member 22 and 24 so that contact members 150 of a probe 152 can be electrically connected with terminal members 22 and 24 to check the terminations and connections thereof while connectors 10 are in position on panelboard 16 as shown in FIG. 1. Sections 62 and 96 of terminal members 22 and 24 have beveled surfaces 154 to facilitate the positioning of contact members 150 into engagement with projections 156 so that the contact members 150 are disposed between projections 156 and the inside surface of housing member 20.

When housing member 20 is moved to cam spring section 80 free of pin terminal 14 via camming surface 50, undercut section 122 of housing member 20 moves along and relative to relief areas 120 and 142 of cover members 28 and 26.

Figure 9:
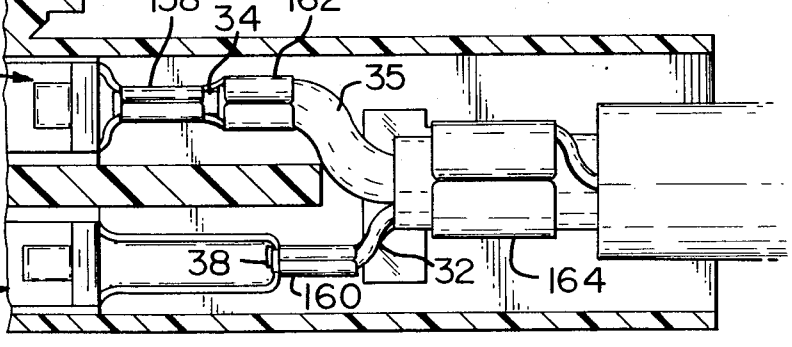
FIG. 9 is a part longitudinal section view of an alternative embodiment.

FIG. 9 shows ferrule sections 158 and 160 of signal terminal member 22 and ground terminal member 24 which are crimped onto signal conductor 34 and ground conductors 32 and 28. Ferrule sections 162 and 164 of terminal members 22 and 24 also are crimped onto insulation sheath 35 and insulating jacket 36 and ground conductor 38.

We claim:

1. An electrical connector for terminating signal and ground conductor means of a trilead cable means and electrically connecting the signal and ground conductor means respectively to a pin terminal and a ground rail of a panelboard, comprising:

dielectric housing means having parallel passageway means extending therethrough which communicate with respective opening means at a front end of said housing means into which the pin terminal and ground rail extend;

signal terminal means disposed along one of said passageway means and including contact means and termination means, said contact means being in alignment with said opening means for electrical connection with the pin terminal, said termination means spaced outwardly from a rear end of said housing means for terminating the signal conductor means thereto;

ground terminal means disposed along the other of said passageway means and including contact member means and termination member means, said contact member means being in alignment with said opening means for electrical connection with the ground rail, said termination member means spaced outwardly from a rear end of said housing means and from said termination means of said signal terminal means for terminating the ground conductor means thereto;

one of said signal terminal means and said ground terminal means having cable securing means for engagement with the cable means securing the cable means thereto and providing a cable strain relief;

terminal securing means on said signal terminal means and said ground terminal means and said housing means securing said terminal means in said housing means; and dielectric cover means secured in position in engagement with said housing means and covering said termination means and said termination member means and engaging a section of the cable means rearward from said cable securing means providing additional cable strain relief.

2. An electrical connector as set forth in claim 1, wherein apertures are located in said cover means in alignment with intermediate sections of said signal and ground terminal means so that electrical contact members of an electrical probe means can pass through the apertures and make electrical connection with the intermediate sections.

3. An electrical connector as set forth in claim 1, wherein said contact means of said signal terminal means includes latching means which latchably engages the pin terminal when electrically connected therewith, cam surface means in said passageway means of said housing means containing said signal terminal means engageable with a section of said latching means when the housing means is moved relative to said signal terminal means thereby causing said latching means to be unlatched from the pin terminal enabling the connector to be disconnected from the pin terminal and the ground rail.

4. An electrical connector as set forth in claim 1, wherein said cable securing means is part of said ground terminal means.

5. An electrical connector as set forth in claim 1, wherein said cover means includes cover members latchably secured together and projection means engageable with the section of the cable means.

6. An electrical connector as set forth in claim 1, wherein said cable securing means is part of said signal terminal means.

7. An electrical connector as set forth in claim 1, wherein said signal terminal means includes a ferrule section rearward from said termination means crimpable to an insulation sheath on said signal conductor means.

8. An electrical connector as set forth in claim 1, wherein said termination means of said signal terminal means is a ferrule section crimpable to said signal conductor means.

9. An electrical connector as set forth in claim 1, wherein said termination member means of said ground terminal means is a ferrule section crimpable to said ground conductor means.

* * * * *